US008210623B2

(12) United States Patent
Chen et al.

(10) Patent No.: US 8,210,623 B2
(45) Date of Patent: Jul. 3, 2012

(54) SLIDING ASSEMBLY WITH DAMPING DEVICE

(75) Inventors: Ken-Ching Chen, Kaohsiung Hsien (TW); Chien-Li Huang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 343 days.

(21) Appl. No.: 12/696,521

(22) Filed: Jan. 29, 2010

(65) Prior Publication Data

US 2011/0187254 A1 Aug. 4, 2011

(51) Int. Cl.
*A47B 88/00* (2006.01)

(52) U.S. Cl. ..... 312/331; 312/334.8

(58) Field of Classification Search ..... 312/350, 312/334.7, 331, 402, 334.1, 334.8, 319.1
See application file for complete search history.

(56) References Cited

U.S. PATENT DOCUMENTS

| | | | | | |
|---|---|---|---|---|---|
| 1,758,550 | A * | 5/1930 | Wolters | 312/331 |
| 1,902,795 | A * | 3/1933 | Wolters | 312/331 |
| 3,857,618 | A * | 12/1974 | Hagen et al. | 384/18 |
| 5,135,294 | A * | 8/1992 | Ohshima et al. | 312/319.1 |
| 5,216,558 | A * | 6/1993 | Griffith et al. | 360/99.06 |
| 6,499,818 | B2 * | 12/2002 | Brustle | 312/319.1 |
| 6,666,306 | B2 * | 12/2003 | Gasser | 188/82.1 |
| 7,077,488 | B2 * | 7/2006 | Wiklund et al. | 312/333 |
| 2003/0067257 | A1 * | 4/2003 | Gasser | 312/331 |

FOREIGN PATENT DOCUMENTS

| | | | |
|---|---|---|---|
| DE | 19945781 | * | 4/2001 |
| JP | 2005204790 | * | 8/2005 |
| WO | 2004/024480 | * | 3/2004 |

* cited by examiner

*Primary Examiner* — Janet M Wilkens
(74) *Attorney, Agent, or Firm* — Rosenberg, Klein & Lee

(57) ABSTRACT

A slide assembly with a damping device includes a first rail, a second rail, a first support frame, a second support frame, a rack and a damper. The second rail is movable longitudinally relative to the first rail. The first support frame is fixed to the first rail, and the second support frame is fixed to the second rail. The rack is connected to the first support frame. The damper is connected to the second support frame and includes a box and a gear which is pivotally connected to the box. The box includes a damping material received therein. When the second rail is moved relative to the first rail, the gear is driven by the rack and rotates while the damping material provides a damping force to the movement of the second rail.

8 Claims, 6 Drawing Sheets

SLIDING ASSEMBLY WITH DAMPING DEVICE

FIELD OF THE INVENTION

The present invention relates to a damping device, and more particularly, to a damping device used on a sliding assembly.

BACKGROUND OF THE INVENTION

As shown in FIG. 6, a conventional sliding assembly generally includes a first rail 1, a second rail 2 and a rolling media such as a plurality of rollers or balls 3 engaged within a retainer 4. The rolling media allows the second rail 2 to be slidably moved relative to the first rail 1. Generally, the sliding assembly is used on the rack for servers, cabinets of furniture or the like. For instance, the first rail is connected to a rack, a cabinet or a fixed object, and the second rail is fixed to a chassis, a drawer or a movable object. The chassis, the drawer or the movable object can be pulled away from the rack, the cabinet or the fixed object.

U.S. Pat. No. 7,077,488 to Wiklund discloses a "DRAWER CLOSING MECHANISM", wherein the closing mechanism of the drawer includes a rack which is fixedly positioned relative to the drawer, a driving gear installed to a piece of furniture or a fixed rail of the drawer and engaged with the rack, a spring having a first end connected and wrapped on the driving gear and a second end of the spring being fixed. When the drawer is pulled out, the driving gear is driven by the rack and the spring is tightened and stores energy. When the drawer is retracted, the spring releases the energy and the drawer is moved to be retracted. The driving gear and the spring occupy a significant space and are not suitable to be installed on objects that require only less space. Furthermore, the drawer does not have a damping effect when moving relative to the furniture, especially the damping for the complete travel distance.

SUMMARY OF THE INVENTION

The present invention intends to provide a damping device for a slide assembly and the damping device ensures that the relative movement between the rails of the slide assembly includes a proper damping force during the travel distance, so that the load on the rails can be moved in a stable status and in a safety mode.

The present invention relates to a slide assembly and comprises a first rail having a first end and a second end which is located opposite to the first end. A second rail is movable longitudinally relative to the first rail. A damping device includes a first support frame fixed to the first rail and the first support frame has a first transverse portion. A rack is connected to the first transverse portion of the first support frame and has a plurality of teeth which are located between the first and second ends of the first rail. A second support frame is fixed to the second rail. A damper is connected to the second support frame and includes a box and a gear is pivotally connected to the box. The box has a damping material received therein and provides a resistance force to the gear which is engaged with the teeth.

The first support frame includes a first upright portion which extends downward from the first transverse portion. A second transverse portion extends transversely from the first upright portion. A second upright portion extends downward from the second transverse portion.

The first upright portion of the first support frame includes a plurality of engaging holes and the rack includes a plurality of engaging members which are located corresponding to the engaging holes. Each engaging member has a hook which engages the engaging hole.

The hook extends through the engaging hole corresponding thereto and is located between two sides of the first and second upright portions.

The first upright portion of the first support frame includes a plurality of apertures and the rack includes a plurality of protrusions which are engaged with the apertures.

The damper includes two wings extending from the box and fixing members to fix the wings to the second support frame.

The rack includes a groove with which the first transverse portion of the first support frame is engaged.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
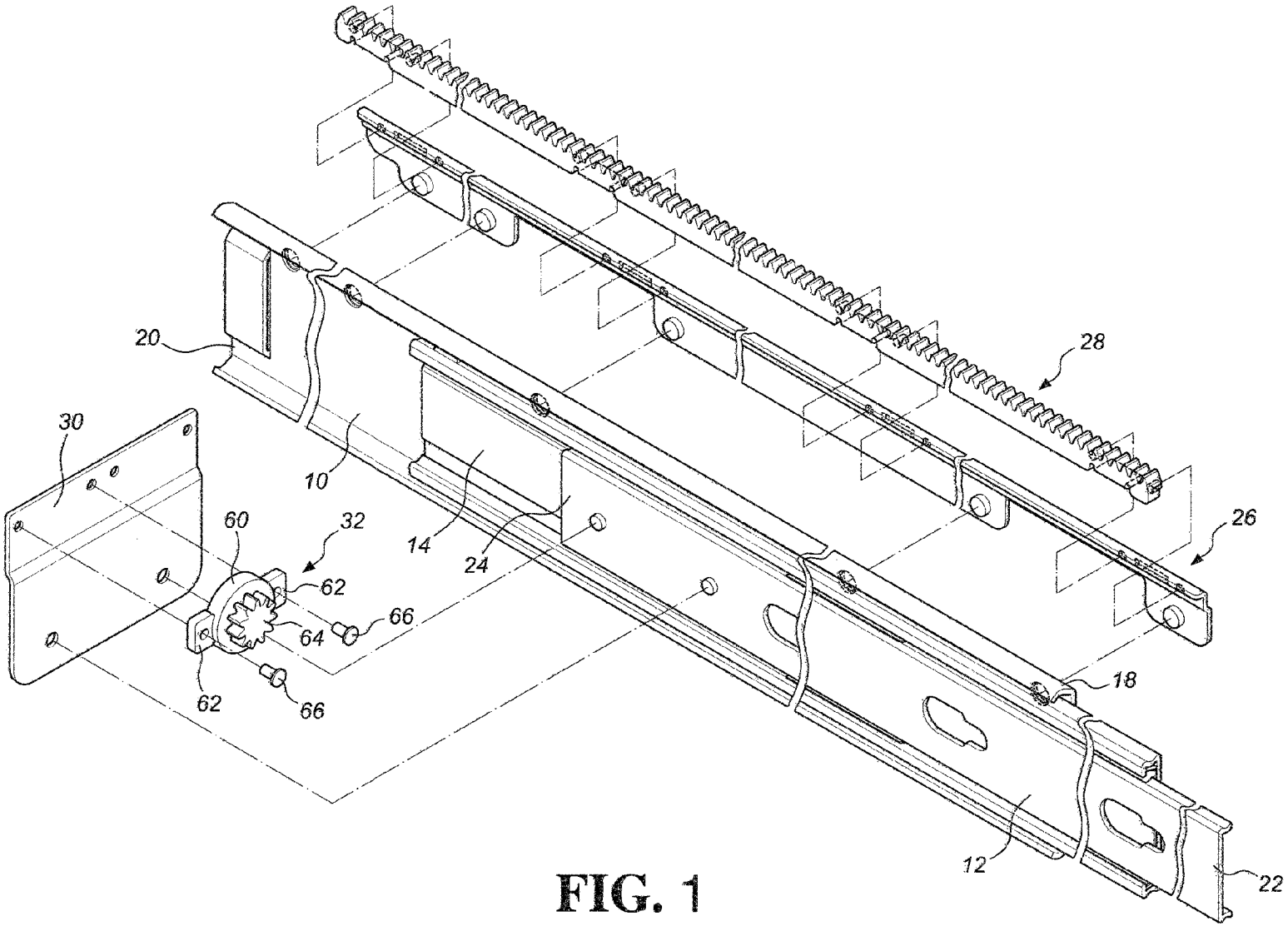
FIG. 1 is an exploded view to show the damping device and the slide assembly of the present invention.
Figure 2:
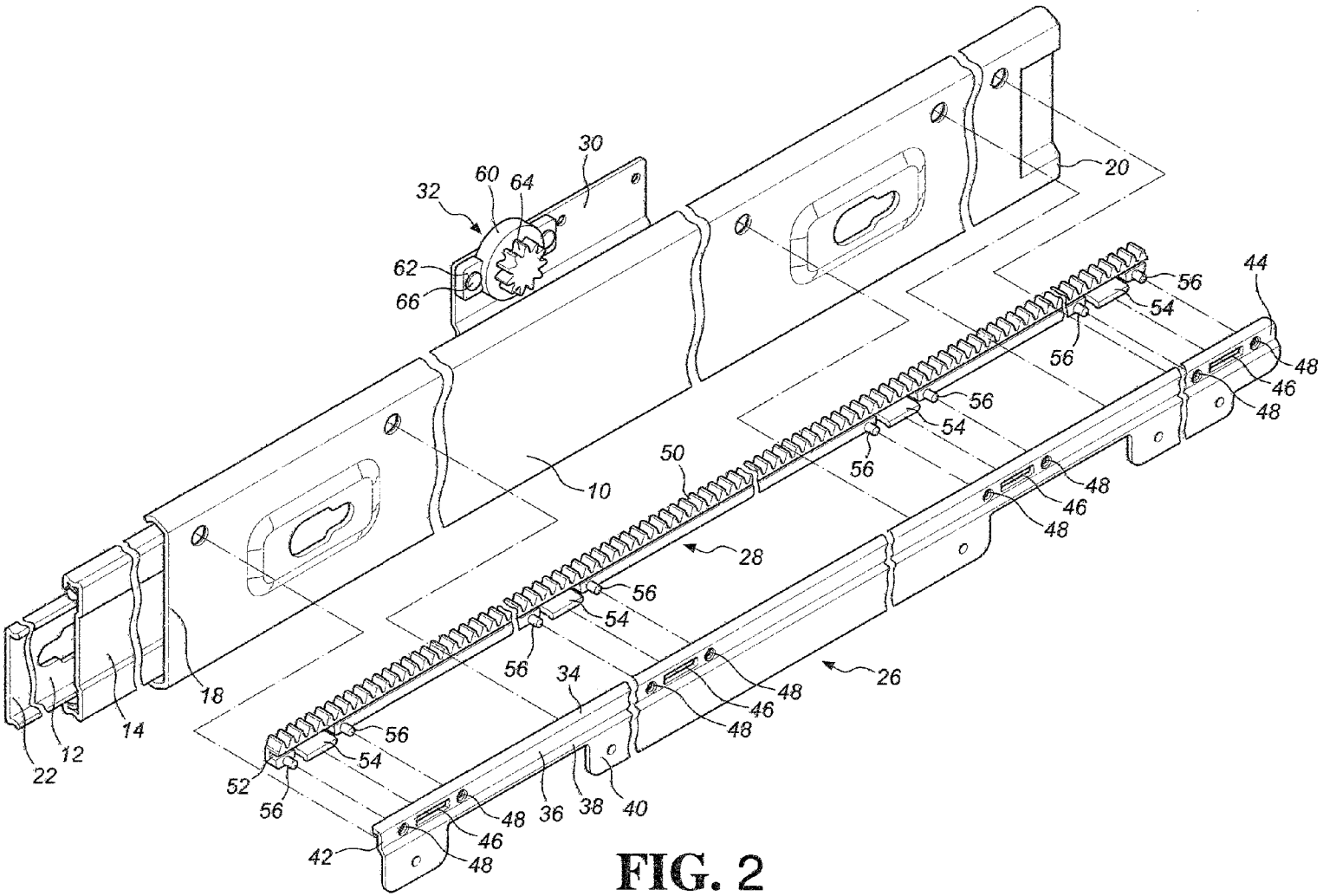
FIG. 2 is another exploded view to show the damping device and the slide assembly of the present invention.

Referring to FIGS. 1 and 2, the slide assembly of the present invention comprises a first rail 10, a second rail 12 movable longitudinally relative to the first rail 10, and a third rail 14 slidably connected between the first and second rails 10, 12. The second rail 12 is supported by the third rail 14 when the second rail 12 is pulled relative to the first rail 10, and the second rail 12 can be pulled to a further distance. Relatively, the distal end of the second rail 12 can be moved to the first end 18 (the front end) of the first rail 10. A damping device is connected relative to the first and second rails 10, 12.

The first rail 10 includes a first end 18 and a second end 20 which is located opposite to the first end 18. In the drawing, the first end 18 is the front end of the first rail 10, and the second end 20 is the rear end of the first rail 10.

The second rail 12 includes a first end 22 and a second end 24 which is located opposite to the first end 22. In the drawing, the first end 22 is the front end of the second rail 12, and the second end 24 is the rear end of the second rail 12.

Figure 4:
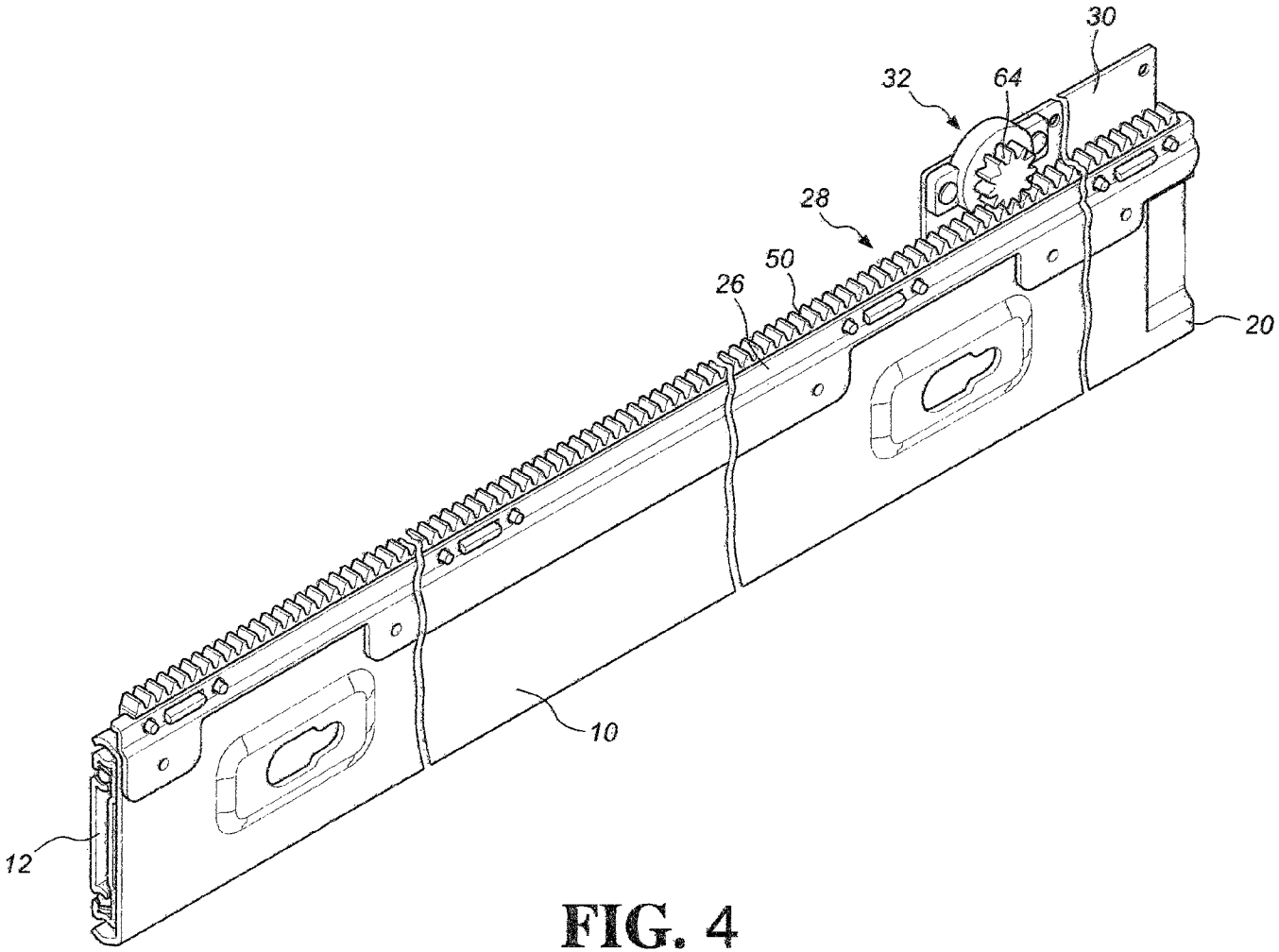
FIG. 4 shows the damping device when the slide assembly is in a retracted status.

The damping device includes a first support frame 26 fixed to the first rail 10, a rack 28 connected to the first support frame 26, a second support frame 30 fixed to the second rail 12, and a damper 32 connected to the second support frame 30. The rack 28 is engaged with the damper 32 as shown in FIG. 4.

The first support frame 26 includes a first transverse portion 34, a first upright portion 36 extending downward from the first transverse portion 34, a second transverse portion 38 extending transversely from the lower end of the first upright portion 36, and a second upright portion 40 extending downward from the second transverse portion 38. The first transverse portion 34 includes a first end 42 and a second end 44 which is located opposite to the first end 42 in longitudinal direction. The first upright portion 36 of the first support frame 26 includes a plurality of engaging holes 46 and a plurality of apertures 48. The second upright portion 40 is fixed to the first rail 10 by way of riveting.

Figure 3:
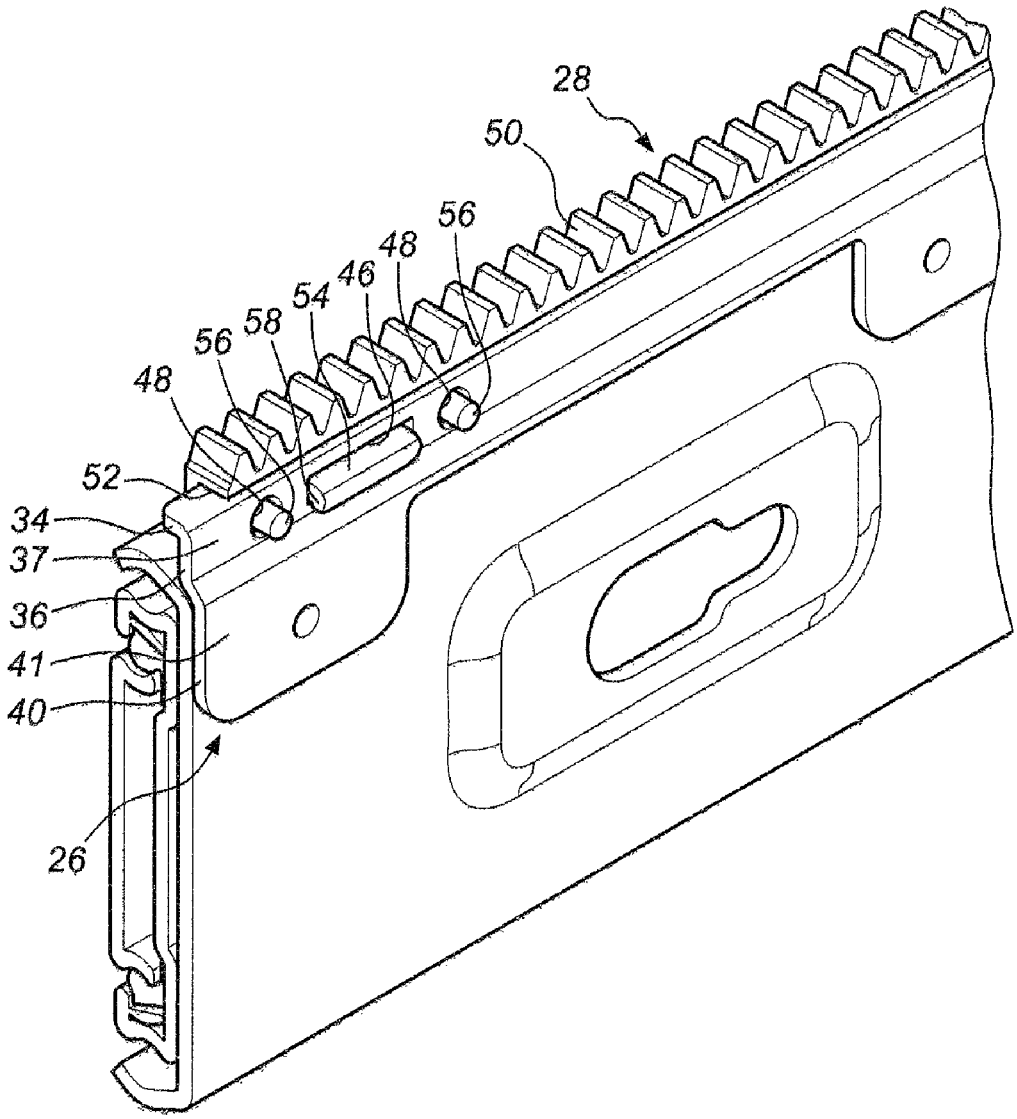
FIG. 3 shows that the damping device is connected to the slide assembly.

The rack 28 is connected to the first transverse portion 34 of the first support frame 26, and includes a plurality of teeth 50 which are located between the first and second ends 18, 20 of the first rail 10. As shown in FIG. 3, the rack 28 includes a groove 52 with which the first transverse portion 34 of the first support frame 26 is engaged. The rack 28 includes a plurality of engaging members 54 which are located corresponding to the engaging holes 46. The rack 28 also includes a plurality of protrusions 56 which are located corresponding to the apertures 48. The protrusions 56 are engaged with the apertures 48. Each engaging member 54 has a hook 58 which engages the engaging hole 46 so that the rack 28 is firmly connected to the first support frame 26. In this embodiment, the engaging members 54 are connected to the first support frame 26 by the hooks 58 which extend through the engaging holes 46 and are located between two sides 37, 41 of the first and second upright portions 36, 40. By this arrangement, the hooks 58 do not protrude from the side 41 of the second upright portion 40 and make the first support frame 26 to be flush with the object to which the slide assembly is installed.

The damper 32 includes a box 60, two wings 62 extending from the box 60, and a gear 64 pivotally connected to the box 60. The damper 32 is fixed to the second support frame 30 by using fixing members 66 which can be rivets. The box 60 has a damping material received therein such as thick and sticky liquid. The damping provides a resistance force to the gear 64 when the gear 64 is rotated. The number of the damping device can be increased as needed.

Figure 5:
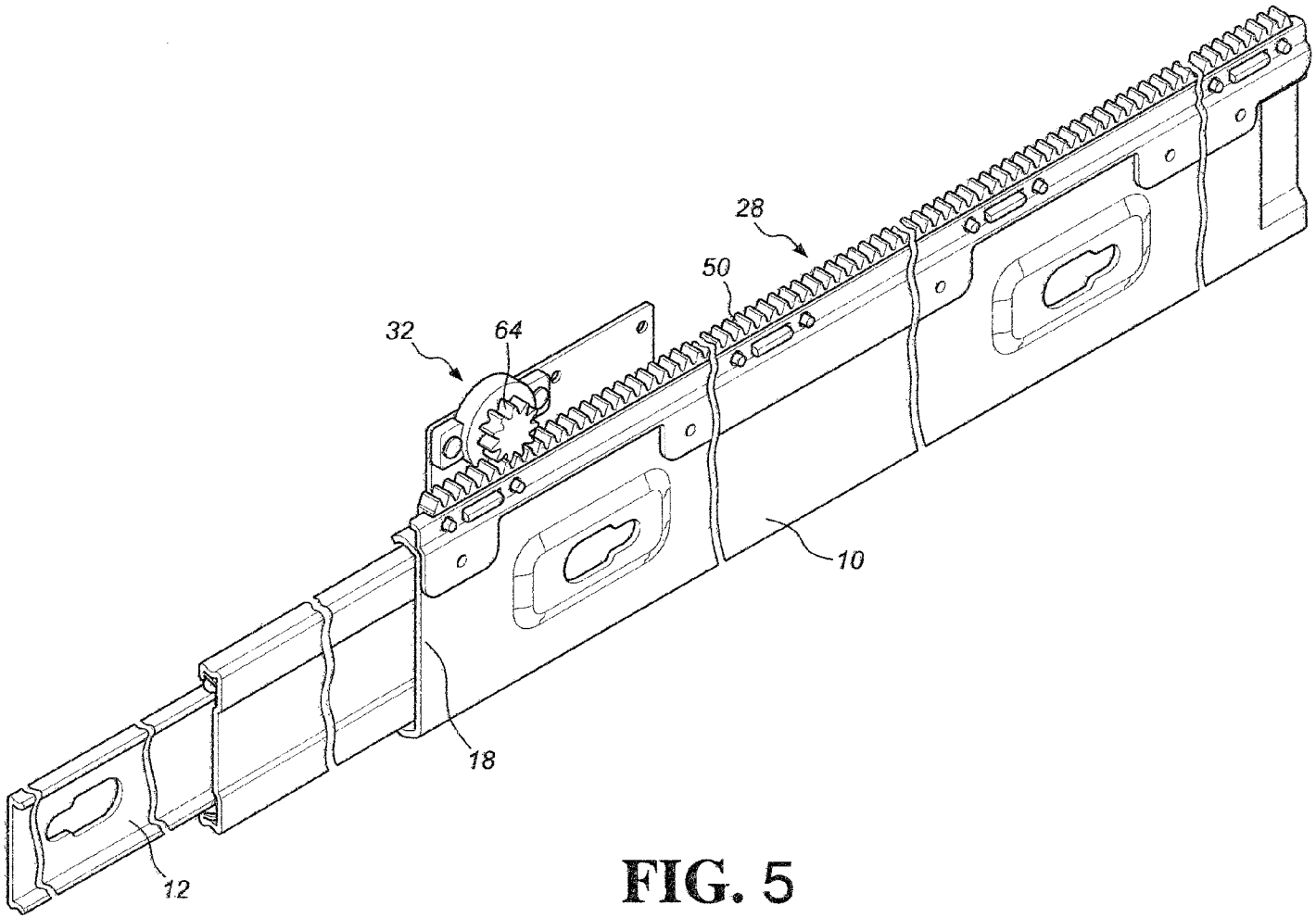
FIG. 5 shows the damping device when the slide assembly is in an extended status.
Figure 6:
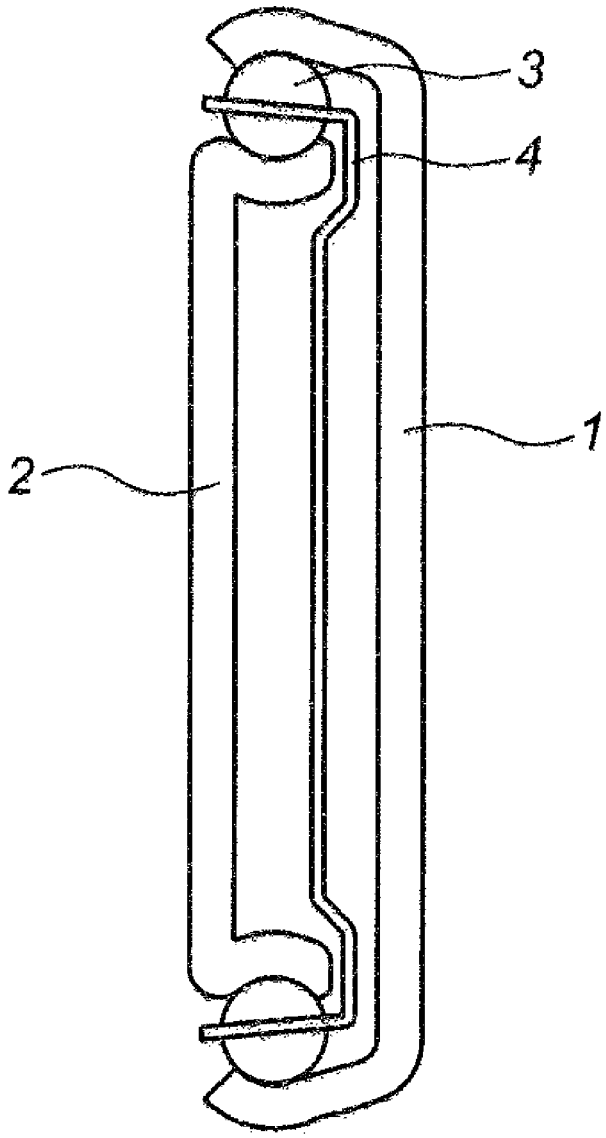
FIG. 6 PRIOR ART
FIG. 6 shows a conventional slide assembly.

FIG. 4 shows the damping device when second rail 12 is in a retracted status relative to the first rail 10. The gear 64 is engaged with the teeth 50 of the rack 28 and the damper 32 is located at the second end 20 of the first rail 10. When the second rail 12 is pulled away from the first rail 10 as shown in FIG. 5, the gear 64 is rotated by the teeth 50 of the rack 28 and the damping material provides a resistance force to the gear 64. When the second rail 12 is fully extended, the damper 32 is moved to the first end 18 of the first rail 10, that is to say, the front end of the first rail 10. Therefore, the travel distance of the second rail 12 relative to the first rail 10, no matter the second rail 12 is pulled out or retracted in, the gear 64 of the damper 32 is engaged with the teeth 50 of the rack 28. The damping force slows down the movement of the second rail 12 relative to the first rail 10, so that the second rail 12 can be moved steadily.

While we have shown and described the embodiment in accordance with the present invention, it should be clear to those skilled in the art that further embodiments may be made without departing from the scope of the present invention.

What is claimed is:

1. A slide assembly with a damping device, comprising:

a first rail having a first end and a second end located opposite to the first end;

a second rail movable longitudinally relative to the first rail;

the damping device including a first support frame fixed to the first rail and the first support frame having a first transverse portion;

a rack connected to the first transverse portion of the first support frame, the rack having a plurality of teeth which are located between the first and second ends of the first rail;

a second support frame fixed to the second rail, and a damper connected to the second support frame, the damper including a box and a gear pivotally connected to the box, the box having a damping material received therein and providing resistance force to the gear, the gear is engaged with the teeth.

2. The slide assembly with a damping device as claimed in claim 1, wherein the first support frame includes a first upright portion which extends downward from the first transverse portion, a second transverse portion extends transversely from the first upright portion, and a second upright portion extends downward from the second transverse portion.

3. The slide assembly with a damping device as claimed in claim 2, wherein the first upright portion of the first support frame includes a plurality of engaging holes and the rack includes a plurality of engaging members which are located corresponding to the engaging holes, each engaging member has a hook which engages the engaging hole.

4. The slide assembly with a damping device as claimed in claim 3, wherein the hook extends through the engaging hole corresponding thereto and is located between two sides of the first and second upright portions.

5. The slide assembly with a damping device as claimed in claim 2, wherein the first upright portion of the first support frame includes a plurality of apertures and the rack includes a plurality of protrusions which are engaged with the apertures.

6. The slide assembly with a damping device as claimed in claim 1, wherein the damper includes two wings extending from the box and fixing members to fix the wings to the second support frame.

7. The slide assembly with a damping device as claimed in claim 1, wherein the rack includes a groove with which the first transverse portion of the first support frame is engaged.

8. The slide assembly with a damping device as claimed in claim 1, further comprises a third rail which is slidably connected between the first and second rails, wherein the second rail is supported by the third rail when the second rail is pulled relative to the first rail.

* * * * *